United States Patent [19]

Winter, Jr.

[11] Patent Number: 4,998,487

[45] Date of Patent: Mar. 12, 1991

[54] NOVEL COAL COMBUSTION METHOD

[76] Inventor: Charles H. Winter, Jr., Suite 802, 1301 N. Harrison St., Wilmington, Del. 19806

[21] Appl. No.: 549,924

[22] Filed: Jul. 9, 1990

[51] Int. Cl.[5] ..... F23D 1/00

[52] U.S. Cl. ..... 110/347; 110/204; 110/264; 110/345

[58] Field of Search ..... 110/264, 347, 165 R, 110/204, 345

[56] References Cited

U.S. PATENT DOCUMENTS 2,747,526 5/1956 Seidl ..... 110/264

4,566,392 1/1986 Ishihara ..... 110/165 R

*Primary Examiner*—Edward G. Favors

*Attorney, Agent, or Firm*—Samuel V. Abrams; John S. Munday

[57] ABSTRACT

This invention is directed to an apparatus for the combustion of coal comprising a heated tubular reactor having combined air and granular coal inlet means for tangentially introducing air and granular coal into the reactor, external heating means, insulation means, and an outlet means wherein the coal is partially burned in the heated tubular reactor to a temperature 50 to 100 degrees Fahrenheit below the fusion temperature of the ash produced from the coal to be used to produce partial combustion products composed of coke, ash and combustion gases. The partially combusted products exiting from the tubular reactor are tangentially introduced with additional air into a second tubular reactor here they are completely burned.

10 Claims, 1 Drawing Sheet

NOVEL COAL COMBUSTION METHOD

FIELD OF THE INVENTION

This invention is directed to a coal burning apparatus and more particularly it is directed to a granulated coal burning furnace.

SUMMARY OF THE PRIOR ART

It is difficult to control conventional coal stokers at a low percentage of their design rate or to prevent clinker formation at a high rate.

Although bituminous coal is much cheaper than fuel oil or gas, on the basis of heat content alone, convenience and economics often dictate the use of fuel oil or gas particularly in smaller installations such as those using only 1 to 7 pounds of coal per hour, for a number of reasons:

(1) Fluids are more easily handled and distributed than solid coal.

(2) On site grinding or pulverization of coal may be required.

(3) Clinker formation may be a problem.

(4) Ash handling and disposal is required for coal.

(5) The ease of ignition of oil or gas permits the use of off-on control with attendant advantages, e.g., avoiding the turn-down problem for light loads.

(6) Many coals contain excessive sulfur which pollute the atmosphere with sulfur dioxide or requires its removal.

The system of this invention comprises the following components:

1. Coal Preparation

Raw coal is crushed to a size of 20 to 40 mesh which is much coarser than the coal used in pulverized coal furnaces. This facilitates centrifugal separations in furnaces and dust collection. Limestone, if required, is then added to absorb sulfur dioxide. The limestone is pulverized to 20 to 40 mesh.

2. Coal Delivery and Ash Pickup

The free-flowing properties of the prepared fuel permits handling in conventional air-fluidized tank trucks. Coal could be delivered to a customer's sealed bin, which would be conveniently located, e.g., outdoors. Similarly, ash would be pumped from the customer's ash bin to an ash compartment on the truck for sale or landfill disposal.

3. Coal Feeding

The free-flowing coal/limestone fuel would then be fed by a conventional screw feeder or table feeder, and then conveyed by about $\frac{1}{3}$ the total air required and delivered to a partial gasification unit.

4. Partial Gasification

The air/fuel mixture from the feeder is reacted in an externally heated tube at a temperature safely below the fusion temperature of the coal ash. External heat is not required after fuel ignition.

5. Final Combustion Unit

Completion of the combustion of the gaseous and solid products of the partial combustion unit takes place in a final combustion unit, a bare metal cylinder resembling a cyclone. Heat is radiated and/or convected to useful purposes. Some fraction of the cyclone gas is recycled from the bottom cone to the top inlet to convey recycle solids and insure a high percentage of combustion.

6. Heat Recovery

About half the heat of combustion is dissipated usefully from the final combustion unit; the other half is recovered from the flue gas by means of a conventional heat exchanger.

7. Ash Recovery

Ash and calcium sulfate dust would be kept in suspension through a heat recovery unit by maintaining adequate conveying gas velocity. Cooled flue gas would then be conducted to an ash storage bin in a convenient location, e.g. outdoors to a cyclone. On small installations, a small, efficient cyclone may provide adequate dust removal; on larger installations, a back-up bag filter may be required.

It is a purpose of this invention to eliminate or greatly reduce the disadvantages of prior art methods of coal burning to permit the economic burning of coal in much smaller installations than the prior art permits.

My invention overcomes the difficulties previously encountered by using granulated coal and partial gasification. In its simplest form, my invention consists, first, of passing granulated coal having a particle diameter of about 0.01 to 0.03 inch with air through a partial combustion unit (Stage 1) heated to a temperature of about 800 to 1,000 degrees Fahrenheit. The coal/air stream is introduced tangentially to the partial combustion unit at high velocity so that any coal which adheres to the walls is contacted by high velocity gas and burned away at a high rate, thereby preventing progressive buildup of solids on the walls and eventual plugging.

The mixture exiting from the top of the partial combustion unit is then tangentially blown into the top end of a second vessel, the final combustion unit (Stage 2), where complete combustion occurs. Recycling of the mixture produced within Stage 2 comprising the reaction gases, coke and ash from an exit port located at the bottom of said second vessel is provided to assure complete combustion.

SUMMARY OF THE INVENTION

This invention is directed to an apparatus comprising:

(a) a partial gasification unit comprising an externally heated tube, an inlet means for injecting a mixture of granulated coal and air tangentially into one end of the tube and an outlet means deposed at the opposite end of the tube (stage 1);

(b) a jet pump or eductor comprising a powering nozzle, mixing zone and discharge venturi connected to the outlet means of the partial gasification unit, which is powered by the remaining two thirds of the combustion air to suck a portion of the products from the final combustion unit which is recycled to the final combustion unit;

(c) a final tubular combustion unit (Stage 2), connected to the discharger side of the eductor, and equipped with a tangential inlet means, a central gas exhaust means in the manner of a conventional cyclone separator, a central solids discharge means in the manner of a conventional cyclone from which some gas can be drawn along with the solids to assist discharge and recycling and a heat transfer means for the removal of heat from the outer surface to control or limit internal temperature to safely below the ash fusion temperature of the coal being used; and (d) a pipe means operatively connected from the central solids discharge means to the educator for recycling unburned coke particles, along with some ash and sufficient gas to entrain or convey solids.

The mixture injected into the top of the final combustion unit comprises combustion unit product, final combustion air supply and recycled gas At this stage of combustion the coal has been converted to particles of coke. The products from the final combustion unit are exited by means of the central gas exhaust means.

More particularly, this invention is directed to an apparatus for the combustion of granular coal comprising a first tubular reactor having a combined air and granular coal inlet means for tangentially introducing air and granular coal into the reactor, external heating means, insulation means, and an outlet means wherein the coal is partially burned in the tubular apparatus which is heated, by the combustion, to a temperature no more than 50 to 100 degrees Fahrenheit below the fusion temperature of the ash produced from the coal used to produce a partial combustion product composed of unburned coal which has been converted to coke, ash and of combustion gases, which is exited to a jet pump and then tangentially to a second tubular reactor (Stage 2) comprising a cylindrical furnace having a conical shaped portion extending to an outlet means and an exhaust means. Final combustion occurs in said second tubular reactor and the final combustion products are exited from the reactor by the exhaust means for the extraction of heat and disposal to a chimney. The jet pump receives, at its inlet, air and partial combustion products from the first tubular reactor and from its vacuum section recycled solids and gas from Stage 2. By injecting the fuel tangentially into the tubular reactor of the furnace, substantially all the coal is burned without exceeding the ash fusion temperature which would cause clinker formation or plugging. The ash produced has a powdery consistency.

DESCRIPTION OF THE DRAWINGS

The novel features that are considered characteristic of this invention are set forth with particularity in the appended claims. The invention, itself, however, both as to its organization and method of operation as well as additional objects and advantages thereof, will be best understood from the following description when read in connection with the accompanying drawings in which:

DESCRIPTION OF THE PREFERRED EMBODIMENTS

Figure 1:
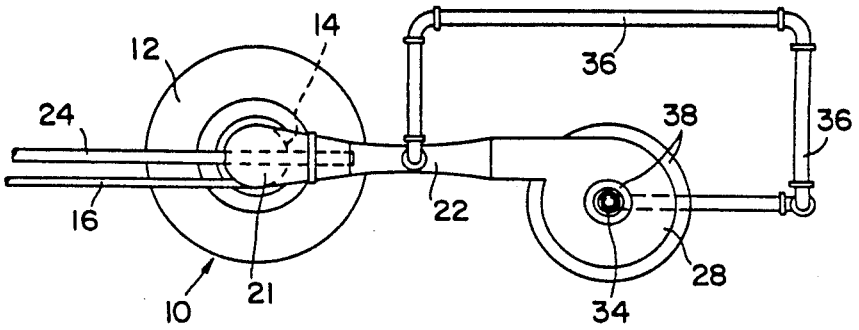
FIG. 1 is a top plan view of the furnace of this invention.
Figure 2:
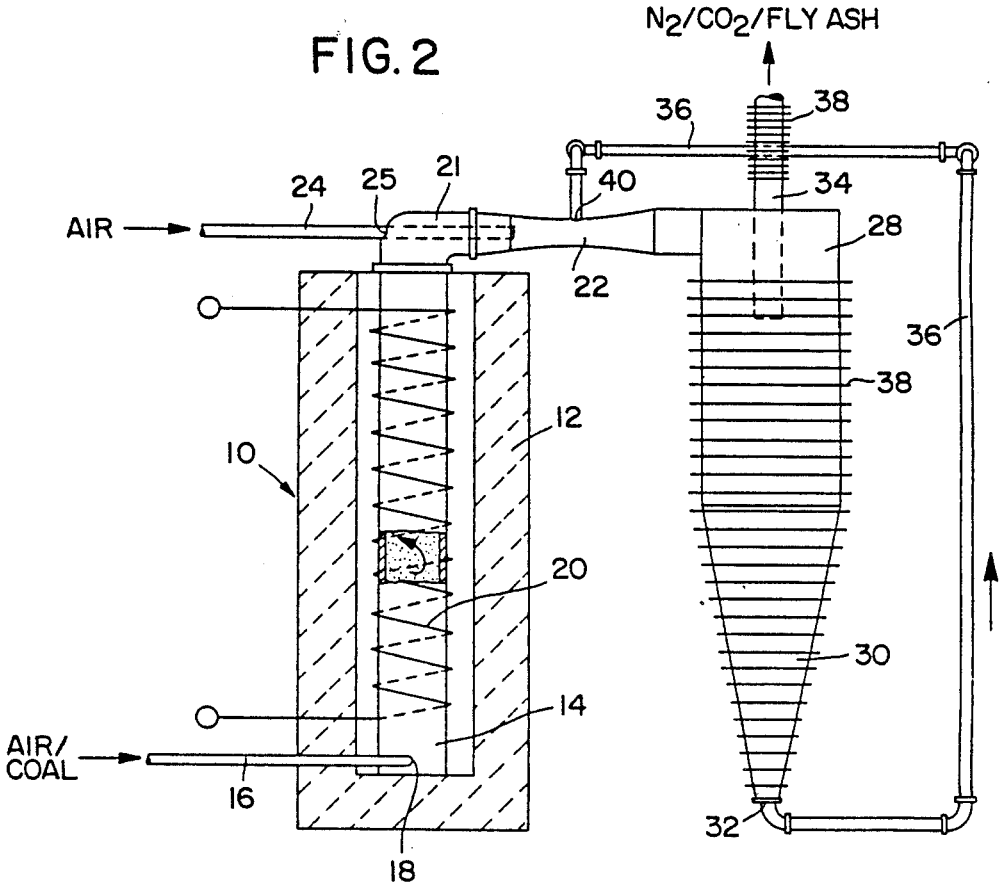
FIG. 2 is a side elevational view partially broken away of the invention.

The system of this invention comprises the following components:

Referring to the drawing, FIGS. 1 and 2 show the details of my furnace 10. Air and granulated coal are fed by a first inlet pipe 16 tangentially in an opening 18 on the side of a partial combustion unit 14 to create a vortex of air and granulated coal within the partial combustion unit. The first inlet pipe 16 enters the partial combustion unit at the bottom thereof The vortex prevents buildup of coal on the inner surface of partial combustion unit. The velocity of the air coal mixture introduced into the partial combustion unit is about 50 feet per second. The partial combustion unit is heated to a temperature of 800 to 1,000 degrees Fahrenheit by means of an electrical resistance heating element 20 which is connected to an electric power source. The electrical resistance heating element should be capable of heating the partial combustion unit to at least 1000 degrees Fahrenheit The partial combustion unit is enclosed in an insulated container containing fire brick or ceramic wool insulation. Partial combustion of the coal occurs within the partial combustion unit producing heat to the extent that the power to the heating element can be decreased or totally eliminated Conventional temperature controls, not shown, can be used to regulate the supply of electrical power to the heating element to control the temperature within the partial combustion unit. The partial combusted mixture of fuel and combustion gases passes out of the top of the partial combustion unit by means of outlet pipe 21. A second air inlet pipe 24 leads into outlet pipe 21 at opening 25 for the introduction of secondary air into the furnace. The amount of secondary air required for the amount of air/coal mixture used is about 8 pounds per pound of coal. The secondary air/partially combusted mixture is passed through a jet pump or eductor 22 and then tangentially into the top of the final combustion unit 28 which is the shape of a tube to create a vortex therein. Complete combustion of the partially combusted mixture occurs within the final combustion unit.

The heat produced is radiated into the space to be heated by means of heat transfer elements 38. The lower end of the final combustion unit 30 is conically shaped and is equipped with an outlet 32 at the lower end thereof to which a pipe 36 is connected with the other end being connected at the jet pump 22. Pipe 36 conveys part of the ash/uncombusted coal, ash and combustion gases to the jet pump 22 through an inlet 40 in the jet pump where it is recycled to the final combustion unit. The remainder of the combustion ash/uncombusted coal, and combustion gases shown as $N_2/CO_2$/fly ash is exited out of the final combustion unit through a central exhaust, exit pipe. Heat from that final flue gas mixture, about one-half of the total fuel value is largely recovered in a conventional heat exchanger (not shown).

Raw coal, preferably bituminous coal, is crushed and ground to about 0.03 inch to 0.01 inch using conventional crushing means and classifiers to minimize dust production. Powdered limestone can be added commensurate with the sulfur content of the coal. Typically 5% of powdered limestone can be used. The mix is then dried. The above steps assure free-flowing properties for handling and metering of solids. The 0.03 inch to 0.01 inch size for the powder has been found to have acceptable heating and burning times in subsequent steps.

Free-flowing powder fuel is fed by gravity to a conventional screw feeder or table feeder set to deliver a constant hourly rate, e.g., 7 to 8 pounds per hour for a 100,000 BTU/hr. installation. This fuel is entrained in approximately one third of the air required for complete combustion, approximately 5 pounds of air per pound of fuel. The feeder operates in an on-off fashion in response to the demand for heat using a conventional thermostat. Air flow can be operated in an on-off fashion, turning on a few seconds before the coal feed starts and stopping several seconds after the coal feed stops. Fuel can be conveyed pneumatically to the partial gasification unit.

The air-fuel mixture from the feeder is then blown tangentially into one end of the partial combustion unit which is in the shape of a tube. This unit, for a 100,000 BTU/hr. installation, is about three inches in diameter and 12–18 inches long; it is surrounded by an auxiliary heat supply, e.g., electric heat and thermal insulation to permit economic maintenance of ignition temperature during prolonged shut down of fuel burning. Auxiliary heat is not needed during normal operation because of the heat generated by the partial combustion of the fuel and the heat capacity of the unit and its surrounding furnace.

I find that the typical product of the partial gasification unit burning 30% volatile bituminous coal is hydrogen and carbon monoxide plus 20-30% particulate coke of a size somewhat smaller than the coal fed. Typical exit temperature is 1800 Fahrenheit. There is a small amount of buildup of fuel which occurs on the walls of the partial combustion unit but such growth is limited by increased gas velocity and burning rate. Plugging does not occur unless an air-fuel ratio is used which results in temperature within the unit above the ash fusion temperature.

The final combustion unit has the following functions:

(1) Complete combustion of the hydrogen and carbon monoxide from the partial combustion unit.

(2) Retention of the particulate coke for sufficient time for its complete combustion to occur-even at 1500 degrees Fahrenheit (3) Cooling of the reacting mass to a temperature favoring the absorption of sulfur dioxide by limestone, approximately—1500 degrees Fahrenheit Roughly half of the total heat must be removed.

(4) Discharge flue gas to the final heat recovery unit at about 1500 degrees Fahrenheit containing ash dust and calcium sulfate dust but substantially free of unburned coke.

(5) For these purposes, a vessel in the form of a centrifugal dust collector or cyclone can be used. Solids retained by the dust collector or cyclone can be recycled.

Heat recovery, for example to circulating air, to circulating water or to boiling water can occur in two stages:

(a) Approximately one-half of the total heat of combustion of the coal must be removed from the final combustion unit, as mentioned above, for two reasons, (1) to reduce the temperature to that favorable for sulfur dioxide absorption by limestone, and (2) to reduce the temperature safely below the ash fusion temperature to prevent plugging. Also, the formation of nitrogen oxide pollutants is inhibited by the use of lower temperature.

The relatively high temperatures of the final combustion unit allows radiation to be the principal mode of heat transfer.

(b) The remaining heat leaving the final combustion unit with the flue gas, consisting of about half of the total heat, can be recovered using a conventional heat exchanger.

Ash and calcium sulfate dust can be kept in suspension through the heat recovery unit by maintaining adequate gas velocity. Cooled flue gas would then be conducted to the ash storage bin at a convenient location, e.g., outdoors to a cyclone. On small installations, the small, efficient cyclone may provide adequate dust removal; on larger installations, a back-up bag filter may be required.

I CLAIM

1. A process for burning coal to recover the heat values contained therein comprising:

tangentially injecting air and granulated coal into a first tubular reactor for partial combustion, said air being less than the amount of air required for complete combustion of said granulated coal, and heating said air and coal initially with external heat to a temperature 50 to 100 degrees Farenheit below the ash fusion temperature of the ash produced during said combustion and thereafter using insulation to maintain said heat, to produce a partial combustion mixture of coke, ash and combustion gases, and removing said partial mixture.

2. The process of claim 1 which further includes the step of tangentially injecting said removed partial mixture with sufficient air to permit complete combustion of said mixture into a second tubular reactor positioned to radiate heat from said complete combustion into an adjacent space while maintaining said complete combustion at a temperature 50 to 100 degrees Farenheit below said ash fusion temperature.

3. The process of claim 1 which further includes the step of removing ash and exhaust gases from said second tubular reactor.

4. The process of claim 1 where a portion of the combustion mixture in the second tubular reactor is recycled.

5. The process of claim 4 wherein the coal has a particle size of 20 to 40 mesh.

6. The process of claim 5 wherein an amount of powdered lime sufficient to react with the sulfur in the coal is mixed with the coal.

7. A process for burning coal to recover the head values contained therein comprising:

(a) tangentially injecting air and granulated coal into a first tubular reactor for partial combustion, said air being less than the amount of air required for complete combustion of said granulated coal, and heating said air and coal to a temperature 50 to 100 degrees Farenheit below the ash fusion temperature of the ash produced during said combustion, to produce a partial combustion mixture of coke, ash and combustion gases, and removing said partial mixture;

(b) tangentially injecting said removed partial mixture with sufficient air to permit complete combustion of said mixture into a second tubular reactor positioned to radiate heat from said complete combustion into an adjacent space while maintaining said complete combustion at a temperature 50 to 100 degrees Farenheit below said ash fusion temperature; and (c) removing ash and exhaust gases from said second tubular reactor.

8. The process of claim 7 where a portion of the combustion mixture in the second tubular reactor is recycled.

9. The process of claim 8 wherein the coal has a particle size of 20 to 40 mesh.

10. The process of claim 9 wherein an amount of powdered lime sufficient to react with the sulfur in the coal is mixed with the coal.

* * * * *